US011891217B2

(12) United States Patent
Georgiadis et al.

(10) Patent No.: US 11,891,217 B2
(45) Date of Patent: Feb. 6, 2024

(54) CONTAINER WITH LID

(71) Applicant: Jokey SE, Wipperfürth (DE)

(72) Inventors: Robert Georgiadis, Bayfield (CA); Mike Löpprich, Marienheide (DE)

(73) Assignee: JOKEY SE, Wipperfurth (DE)

( * ) Notice: Subject to any disclaimer, the term of this patent is extended or adjusted under 35 U.S.C. 154(b) by 65 days.

(21) Appl. No.: 16/665,603

(22) Filed: Oct. 28, 2019

(65) Prior Publication Data

US 2020/0148428 A1 May 14, 2020

(30) Foreign Application Priority Data

Nov. 9, 2018 (DE) ..... 20 2018 106 381.2

(51) Int. Cl.
*B65D 43/26* (2006.01)
*B65D 43/02* (2006.01)
*B65D 43/16* (2006.01)

(52) U.S. Cl.
CPC ..... *B65D 43/26* (2013.01); *B65D 43/0256* (2013.01); *B65D 43/161* (2013.01); *B65D 2543/0062* (2013.01); *B65D 2543/00194* (2013.01); *B65D 2543/00296* (2013.01); *B65D 2543/00527* (2013.01); *B65D 2543/00537* (2013.01); *B65D 2543/00685* (2013.01);
(Continued)

(58) Field of Classification Search
CPC .. B65D 43/161; B65D 43/26; B65D 43/0256; B65D 47/0847; B65D 50/04
USPC ..... 220/810, 835
See application file for complete search history.

(56) References Cited

U.S. PATENT DOCUMENTS

2009/0095699 A1 4/2009 Milante
2011/0024421 A1 2/2011 Luburic
(Continued)

FOREIGN PATENT DOCUMENTS

DE 20215850 U1 2/2004
GB 2445109 A 6/2008
(Continued)

OTHER PUBLICATIONS

Int'l Search Report and Written Opinion dated Aug. 30, 2016 in Int'l Application No. PCT/EP2016/064834.
(Continued)

*Primary Examiner* — Jeffrey R Allen
(74) *Attorney, Agent, or Firm* — Panitch Schwarze Belisario & Nadel LLP

(57) ABSTRACT

A container has an upper container edge and a fully circumferential lateral wall and an upper container opening closed by a lid. A latching rim is provided near the upper container edge for connection with a corresponding latching rim provided on the lid. The lid has a lid rim portion arranged above the upper container edge. The lid has at least one extension extending outside the lateral container wall and below the lid lower edge. The extension and container have mutually corresponding fasteners independently releasable of the latching rims. The lid and/or the container has an actuator area different from the fasteners on the lid extension and the container and/or from the lid extension itself. When the actuator area has been actuated, the fasteners between the lid extension and the container are more easily releasable and, where applicable, easier to close.

21 Claims, 5 Drawing Sheets

(52) U.S. Cl.
CPC ..... *B65D 2543/00731* (2013.01); *B65D 2543/00796* (2013.01)

(56) References Cited

U.S. PATENT DOCUMENTS

2012/0074158 A1* 3/2012 Lafleur ..... B25H 3/02
220/810
2012/0311972 A1* 12/2012 Hunter ..... B65D 65/466
220/592.2
2018/0057226 A1 3/2018 Austin et al.

FOREIGN PATENT DOCUMENTS

WO 2006021034 A2 3/2006
WO 2017001329 A1 1/2017

OTHER PUBLICATIONS

Office Action dated Aug. 10, 2023 in EP Application No. 19 794 132.1-1014 (English Translation is unavailable).

* cited by examiner 9a
16a
17
2
2c
7
11
29
29a
5
10
12
12'
21
25
6
4

CONTAINER WITH LID

CROSS-REFERENCE TO RELATED APPLICATIONS

This application claims priority under 35 U.S.C. § 119(b) to German Application No. 20 2018 106 381.2, filed Nov. 9, 2018, the disclosure of which is incorporated by reference herein in its entirety.

BACKGROUND OF THE INVENTION

The invention relates to a container with a lid according to embodiments disclosed herein.

A generic container is known from WO 2017/001329A1, for example. In addition to the at least substantially completely circumferential latching rims of the lid and container, a lid extension is provided having fastening means which cooperate with fastening means of the container to increase the safety of the container against unauthorized opening by persons such as children. So, two fixing systems are provided here, which have to be operated independently, and which have to be operated sequentially to open the container. Such manipulation of the package consisting of container and lid is often difficult to identify for children or difficult to implement in unintended opening attempts. Nevertheless, there is a desire to provide generic packages with further increased child safety, which hence exhibit high safety against unauthorized, unintended opening. In addition, such containers should exhibit high transport safety, so they should not open unintentionally, for example when falling from a greater height.

The invention is based on the object to provide a container with further enhanced child safety and very good transport safety.

BRIEF SUMMARY OF THE INVENTION

According to the invention, the lid and/or the container has an actuator area to be actuated by application of a force in the vicinity of the fastening means between lid extension and container, wherein after the actuator area has been actuated by application of a force, the fastening means between lid extension and container are more easily releasable than without said actuation of the actuator area. In particular, "more easily releasable" should be understood to mean that in the opening process, that is in the disengaging of the fastening means from each other, less force is required than without prior actuation of the actuator means. This applies in particular after a tamper-evident closure has been removed or displaced, which has to be removed or displaced in a destructive way and which at least partially overlaps the lid extension, for example. "Entire opening process" shall refer to the transferring of said fastening means from their locked position into their open position in which they are disengaged from each other. Here, said actuator area is different from the fastening means on the lid extension and on the container. Preferably, said actuator area is different from the lid extension and/or from the portion of the container to which the fastening means of the container are molded, in particular different from the lid extension. Particularly preferably, said actuator area is spaced apart from the connection portion where the lid extension is molded to the lid and/or from the connection portion where the fastening means are molded to the container. The actuator area is different from any optionally provided tamper-evident closure of the package, which has to be removed from the package or displaced by destroying at least a portion thereof such as a linkage to the container or the lid for the package, in order to gain access to the lid extension. So, in order to open the container it is not only necessary to actuate the additional fastening means directly on the lid extension and/or the corresponding fastening means of the container to disengage them from one another, though these further fastening means already provide additional safety for the connection between the lid and the container, namely in addition to the otherwise usual latching rims of the container and the lid, which extend at least substantially fully circumferentially around the container and by which the lid is fixed in its position preferably tightly sealing the container. So, according to the invention, the process of disengaging the fastening means of the lid extension and the container is preceded by a further manipulating step to enable the lid to be released more easily or particularly preferably at all, that is without destroying the fastening means, namely just by applying a force to actuate the additional actuator area which is provided in the vicinity of the lid extension and/or the fastening means of the container. This inventive design of the package comprising the container and the lid substantially increases the child safety of the container. It has been found that with non-planned action in opening the container, for example only by trial and error without performing the intended manipulations in the predetermined order, the container is not or only very difficult to open. Furthermore, transport safety of the package consisting of the container and the lid is enhanced, since, for example when a package falls down, it is very unlikely that the container will impact with the elastically deformable and/or displaceable area, and this additionally with the required force thereon. Particularly preferably, the actuation of said actuator area of the lid and/or the container by application of a force is required to be able to close the container more easily or at all while interengaging the fastening means of the container and the lid.

Particularly preferably, a force has to be applied to the actuator area of the lid and/or the container, and during such application of a force to the actuator area the fastening means of the lid extension and the container can be released more easily. So, the application of a force to the actuator area and the disengaging of the fastening means has to occur simultaneously in order to allow the fastening means to be released more easily. Here, the actuation of the actuator area by application of a force and the actuation of the or one of the fastening means of the lid extension and the container for releasing the fastening means can be carried out at the same time or successively to allow the fastening means to be released more easily, with actuation of the actuator area in a first step and actuation of the or one of the fastening means in a second, subsequent step. If the force application on the actuator area is relieved after an initial application of force and before the fastening means of the lid extension and the container are released, the releasing of the fastening means will preferably no longer be easier but will rather be given as under the conditions that existed prior to the initial application of force to the actuator area. According to another—less preferred—variant, the fastening means of the lid extension and the container can be brought into an intermediate position by the application of force to the actuator area, that is into a partially released state which is retained or fixed after relieving the force on the actuator area, by means of a suitable fixing means such as a detent, and subsequently the fastening means of the lid extension and the container can then be actuated whereby they will be released more easily and at least substantially completely.

More generally within the context of the invention, the fastening means between the lid extension and the container are preferably positively locking means, particularly preferably they are generally embodied in the form of latching means in the context of the invention. In this case, the positive fit of the positively locking means is preferably reduced or eliminated by the actuation of the aforementioned actuator area. If the positive fit is caused by engagement of a fastening means of the lid extension or the container behind the corresponding fastening means, then preferably the extent of this engagement therebehind is reduced by the actuation of the actuator by application of a force in order to allow the fastening means to be released more easily. For this purpose, the corresponding fastening means may have an undercut. With the actuation of the actuator, the male (positive) fastening means and/or the female fastening means receiving the corresponding fastening means can be displaced so as to allow the fastening means to be released more easily. If the fastening means between the lid extension and the container are frictionally locking means, then the extent of the frictional fit can be reduced by the actuation of the actuator by application of a force in order to allow the fastening means to be released with less effort and hence more easily. Optionally, the fastening means mentioned above may as well represent a combination of positively and frictionally locking means. Preferably, the actuator area and a fastening means that is displaced or deformed by actuation of the actuator area are arranged at the same component selected from the group consisting of the lid and the container. The fastening means may also represent a combination of positively/frictionally locking means, in this case also with the positively locking means in the form of latching means.

Preferably, the actuation of the actuator area by application of a force causes a displacement of the fastening means of the container and the lid relative to each other, preferably a displacement of the fastening means in a direction which is different from the movement of the lid extension during its opening movement. This displacement of the fastening means relative to each other may already constitute a partial or at least substantially complete disengagement of the fastening means from one another, in particular by reducing a positive fit, including if the positively locking means are implemented as latching means, and/or a reduction in the frictional fit of frictionally locking means as described above. The displacement of the fastening means caused by the actuation of the actuator area may be a translational movement, for example. In combination therewith, or generally within the context of the invention, the opening movement of the extension may be a pivotal movement. Such a combined actuation is difficult to carry out by children.

Generally within the context of the invention, the lid extension may be designed to be pivotable. The pivoting may be performed so as to completely disengage the fastening means from one another and/or so as to bring them apart in order to be able to release the lid. The pivotal axis may extend transversely or perpendicular to the main axis of the container, in particular also tangentially to the container lateral wall—preferably in combination of the aforementioned orientation extension. The pivoting of the lid extension can be achieved radially outward with respect to the container, and the corresponding fastening means of the container are preferably arranged radially inward of the lid extension, for example on the container lateral wall or on a portion protruding from the container lateral wall, wherein this portion may also be an area of a skirt or flange surrounding the container in an at least substantially fully circumferential manner, which in the original state of the sealed container is arranged radially inward of the lid extension, for example on a skirt portion of reduced radial extent of the container lateral wall, such as a skirt necking. Alternatively, the lid extension is pivotable radially inward with respect to the container, that is towards the container lateral wall, and the corresponding fastening means of the container may be arranged radially outward of the lid extension. According to this second alternative, the fastening means may be arranged, for example, on a portion of a skirt or flange surrounding the container in an at least substantially fully circumferential manner, wherein in the sealed original state of the package, the portion of the skirt on which the fastening means are provided is arranged radially outward of the lid extension. According to this alternative, the lid extension may, for example, pass or extend through the skirt, and the skirt may have an aperture receiving the lid extension. In this case, the fastening means of the container may be arranged in the vicinity of the skirt aperture, for example at the periphery or edge region thereof. The fastening means may preferably protrude from the skirt or from the edge of the aperture towards the container lateral wall, or the edge of the aperture is formed as a fastening means, below and/or behind which a portion of the lid extension engages.

Particularly preferably, the actuator area to be actuated by application of a force is designed as an elastically deformable and/or reversibly displaceable area of the lid and/or the container. If reference is made in the context of the invention to the elastically deformable and/or reversibly displaceable area of the lid and/or the container, this shall generally be understood to mean said actuator area, but in particular also said elastically deformable and/or reversibly displaceable area. Preferably, the actuator area has to be actuated by exerting a force, such as by applying a pressure or tensile force, in particular by pressing this area against the lid and/or the container.

The actuator area, in particular in its embodiment as an elastically deformable and/or reversibly displaceable area, is preferably permanently integrally molded with the container and/or the lid and remains permanently molded thereto even after having been actuated, preferably without lasting change of the molded area. The actuator area can preferably be actuated non-destructively.

In the context of the invention, "fastening means" shall always be understood to mean the fastening means of the lid extension and the corresponding fastening means of the container, or, according to the respective context, the fastening means of the lid extension or the corresponding fastening means of the container. These fastening means are different from the at least substantially fully circumferential latching rims of the lid and the container (first latching rims), which are preferably provided in the region of or at the upper edge of the container. The fastening means preferably each extend along ≤35% or ≤25% or particularly preferably ≤20% or ≤10% of the container's circumference. Each of the latching rims of the lid and the container, which extend at least substantially around the full circumference of the container, preferably extend along ≥50% or ≥75% or particularly preferably along ≥80% or ≥90% or even completely around the container's circumference, but particularly preferably not in the vicinity of said fastening means, so that after releasing the fastening means the initiation of the unlatching of said latching rims of the container and the lid will be easier. With respect to the height extension of the container, the fastening means are preferably arranged below the first latching rims of the container and the lid, that is closer to the container bottom. Preferably, said fastening means are provided at a level of a skirt protruding from the container lateral wall, in particular at a level of an at least vertically extending portion thereof, which is radially spaced from the container lateral wall, and said first latching rims of the container and the lid, which extend at least substantially around the container's circumference, are provided above said skirt.

In the context of the invention, "extension" shall always be understood to mean the lid extension, "deformation" shall always mean elastic deformation, and "displacement" shall always mean reversible displacement of the area of the lid and/or container in the vicinity of the fastening means between the lid extension and the container, which makes the releasing of the fastening means easier, unless other details are apparent from the context. In the context of the invention, "vertical direction" shall be understood to mean a direction parallel to the main axis of the container. In the context of the invention, "horizontal direction" shall be understood to mean a direction perpendicular to the main axis of the container. In the context of the invention, "downwards" shall be understood to mean in the direction towards the container bottom.

In the context of the invention, the corresponding latching rims of the container and the lid, which are arranged in the vicinity of the upper container edge and which are latchingly engageable with each other and each extend at least around part of the circumference of the container or the lid, will be referred to as "first latching rims" collectively, or individually with respect to the container or the lid as a respective "first latching rim". Here, the "first latching rim" of the container and/or the lid, in particular the "first latching rim" of the container, can be formed so as to extend completely around the container or the lid, respectively.

Particularly preferably, the container and the lid are designed such that during or as a result of the elastic deformation and/or reversible displacement of said area of the lid and/or the container, a displacement of the fastening means of the lid and of the container relative to each other is caused, whereby subsequently, after said deformation and/or displacement of said area of the lid and/or the container, the fastening means between the container and lid can then be released more easily or at all.

Particularly preferably, the container and the lid are designed such that under or during continuing elastic deformation and/or displacement of said area of the lid and/or the container with respect to the not deformed or not displaced state of said area of the lid and/or the container in each case, the fastening means between the container and the lid can be released more easily or at all, compared to the state of the lid and/or container without this deformation or displacement of said area of the lid and/or container. The releasing of these fastening means, for example by displacement such as pivoting of the lid extension, is therefore preferably achieved under continuing elastic deformation of said area of the lid and/or container or in the actuated position of this displaceable area, that is in the displaced position with respect to an initial position in which no manipulations have yet occurred on a container that is originally sealed as intended. Said reversible displacement of the area of the container and/or the lid has in particular to be maintained against a counterforce here, wherein the counterforce corresponds at least substantially to a force which has to be overcome in order to be able to effect this displacement. The counterforce may be generated, for example, by a spring element, which exerts a restoring force after having been deflected and returns to its initial position when relieved. The spring element may, for example, be a bending spring made of plastic material. Thus, the operator has to manipulate the container actively and purposefully, namely in order to maintain said deformation and/or displacement by preferably permanently exerting a force, while said fastening means are released by the same person. In this way, the container and transport safety are significantly increased.

Preferably, the container with lid is designed such that it can only be opened with two hands of the operator but can be closed with one hand, wherein during closing the fastening means of the container and the lid will interengage, preferably into an engagement corresponding to the package in the closed original state. For opening, one hand has to actuate the actuator area by applying a force, preferably actuate the elastically deformable and/or reversibly displaceable area of the container and/or the lid, so as to deform or displace it, and while maintaining the deformation and/or displacement, the fastening means on the lid and the container have to be disengaged by the second hand. When closing the container, the lid can be latched onto the container with one hand in order to close it. For this purpose, the lid can be placed on the container with one hand, and the first latching means or first latching projections of the container and the lid can be latched. By one-handed application of a force to the actuator area, preferably the elastically deformable and/or displaceable area, the fastening means between the lid and the container can then be transferred to their engaged or closed position and can preferably automatically lock when reaching it. Optionally, the steps of locking the fastening means and latching the first latching means may also be performed in reverse order. The automatic locking of the fastening means can be achieved by the fastening means of the lid and/or the container, for example also the lid extension, being biased when the lid is placed on the container, and then, when the fastening means reach the closed position, the fastening means will automatically lock thereby reducing or cancelling out the biasing. The biasing may be achieved by exerting a preferably increasing force onto the actuator area, in particular the elastically deformable and/or displaceable area thereby displacing it, which causes a displacement of the fastening means relative to one another towards reaching the locked position thereof. The biasing may be generated, for example, by a deflection of the fastening means of the container and/or the lid when the lid is being attached, thereby generating a restoring force, and when the closed position is reached this restoring force is released, thereby transferring the fastening means into their locked position. The deflection may be caused, for example, by causing at least one of the two fastening means or both to engage on one another or else on another engagement area on the container and/or the lid, while such engagement causes a displacement of the one or more fastening means, thereby generating the biasing. One or the fastening means may be in particular the lid extension.

The elastic deformation and/or reversible displacement of the area of the lid and/or the container, which makes the releasing of the fastening means between the lid extension and the container easier or possible at all, is preferably carried out in a direction and/or has to be performed in a direction which is different from the intended displacement of the lid extension during the opening movement thereof. Upon "releasing", the fastening means are disengaged intentionally. So, for example, the lid extension may be designed to be pivotable and has to be pivoted in order to disengage the fastening means of the extension and the container, whereas the deformation and/or displacement of said area does not constitute a pivotal movement of said area occurring in the same plane with the pivoting of the lid extension for releasing said fastening means and/or in the same pivoting direction, or particularly preferably does not constitute a pivotal movement per se. Preferably, the extension has to be pivoted for releasing the fastening means between the lid and the container. Preferably, the deformation and/or displacement of said area is achieved by applying a pressure and/or tensile force in an axial direction. Exertion of a pressure towards the container bottom is particularly preferred, since in this case the container is pressed against the ground and stabilized in its position, in contrast to lateral forces by which the container might be displaced. This axial direction can in particular be parallel to the main axis of the container or at an angle of 0 to 60° or 0 to 45°, preferably in the range of 0 to 30° relative thereto. Preferably, the elastic deformation and/or displacement of said area is effected with a directional component downwards, in the vertical direction, i.e. towards the container bottom with respect to the main axis of the container. This refers in particular to a directional component or the main direction of force application for effecting said deformation and/or displacement in each case. The pivoting of the extension may in particular be effected here about a pivotal axis that extends transversely or perpendicular to the main axis of the container, and preferably extends tangentially or parallel to an outer peripheral portion of the container such as a container skirt, or at least substantially parallel to the main axis of the container. The main axis of the container extends perpendicular to the container bottom and to the container opening and preferably through the center of gravity of the container.

Said elastic deformation and/or displacement of said area in order to allow the fastening means to be released more easily is preferably independent of an actuation of the tamper-evident closure of the package. Hence, the lid and the container are preferably designed such that said deformation and/or displacement is effected or has to be performed when the tamper-evident closure has already been opened, that is, for example, has been displaced or removed from the container. However, optionally it is likewise possible that the tamper-evident closure is opened during or by the displacement of the extension by actuating the extension.

Preferably, the lid extension is integrally molded with an elastically deformable and/or reversibly displaceable area of the lid. By deformation or displacement of said area of the lid, the extension can therefore be displaced thereby enabling the fastening means between the extension and the container to be released more easily. In this way, preferably, an immediate force transfer occurs from the deformable and/or displaceable area of the lid to the extension, so that the latter is likewise displaced and the releasing of the fastening means is made easier.

The lateral wall of the container may have a circumferential skirt with a portion extending radially outward from the lateral wall.

Alternatively or additionally, the fastening means of the container may be integrally molded with an elastically deformable and/or displaceable area of the container, and by deformation and/or displacement of this container area the fastening means of the container will be displaced so as to allow these fastening means to be released more easily. For example, the fastening means of the container may be provided on a circumferential skirt of the container, which surrounds the container at least substantially along the entire circumference thereof and is integrally molded with the outer surface of the container wall.

The respective molded connection of the lid extension on the lid and of the fastening means of the container on the container area is preferably designed such that it can be actuated repeatedly in order to repeatedly open and close the container without affecting the molded connection and the fastening means, also if the fastening means of the lid and the container are interengaged thereby in each case. Therefore, the container can be reused repeatedly. So, the respective connection portion is therefore preferably designed so as to be physically stable so as to be able to transfer said displacement of the area to the lid extension and/or to the fastening means of the container.

Preferably, the container with lid is embodied such that the fastening means of the lid extension and of the container are not disengageable from each other in a non-destructive way without previous elastic deformation and/or reversible displacement of said area of the lid or container, and are disengageable from each other in a non-destructive way once said elastic deformation and/or reversible displacement of said area of the lid or container has occurred. In this way, a particularly high safety of the container is provided against unauthorized or unintentional opening, since said previous elastic deformation and/or reversible displacement of said area has to be made mandatorily for releasing said fastening means. Moreover, as a result, the fastening means of the lid extension and the container are particularly reliably secured to the container in this way and cannot be accidentally removed, for example by a child when trying to open the container.

Generally, in the context of the invention an embodiment of the package consisting of container and lid is preferred in which an elastic deformation of said area of the lid or of the container has to be effected in order to release the fastening means more easily or at all. Due to the elastic deformability, the mentioned area of the lid or the container will resume its initial position in the absence of continued actuation, whereby the manipulating of the container is simplified, in particular if the container is opened and closed several times.

Preferably, the fastening means of the lid extension and container as mentioned have to be released independently of the latching means between the container and the lid, which are in the form of first latching rims, before these latching means can be released in a second step. Generally in the context of the invention, the container may have a skirt provided on the outside of the container lateral wall, which may be integrally molded with the container lateral wall and has a skirt portion that extends at least substantially vertically and towards the container bottom. This skirt portion may be linked to the container lateral wall by a transition area which has an extension with a horizontal directional component or an at least substantially horizontal extension. Once the fastening means between the extension and the container have been released, the extension can preferably be displaced relative to the lid, for example by pivoting, and the pivotal axis may extend at least substantially perpendicular to the main axis of the container. Upon displacing of the lid extension, the latter may then expose an access opening for the lower edge of the lid, into which the operator may introduce at least one finger for then gripping the outer edge of the lid to detach the lid from the container thereby unlatching the first latching rims of the container and of the lid from one another. The access opening may be provided in the container skirt or within an interruption thereof. In order to allow the lid to be released more easily, the at least substantially circumferential latching connection between the container and the lid may be interrupted or weakened in the vicinity of the lid extension. The weakening may for example be implemented by providing a plurality of latching projections spaced apart from one another in the circumferential direction of the container or by providing the latching connection with a smaller undercut than in the areas of said latching connection further apart in the circumferential direction from the lid extension. The above embodiments for opening the container may generally apply within the scope of the invention, also irrespectively of the provision of a skirt on the outer side of the container, and also with a different embodiment or arrangement of such skirt.

Particularly preferably, the lid extension and/or the fastening area of the container are integrally molded with a portion of one of the lid and container, also referred to as connection portion below, wherein when pressure is applied to the lid and/or to the container thereby pressing said connection portion against the other one of the lid and container, said connection portion is displaceable thereby causing displacement of the lid extension relative to the fastening area of the container. Hence, by pressing the lid against the container, the connection portion can be pressed against the other component and can thereby be displaced, which can indirectly or preferably directly cause a displacement of the lid extension relative to the fastening area of the container. Said pressure application may be exerted directly on the connection portion. Preferably, said pressure application is exerted indirectly on the connection portion, for example onto an area of the lid and/or the container (pressure area), wherein in the direction of force transfer, the connection portion is located between the fastening means and the pressure area, in particular between the lid extension and the fastening means.

Here, the pressure can be applied on an area of the lid and/or container, which preferably occurs with a vertical direction component or in the vertical direction with respect to the main axis of the container, particularly preferably towards the container bottom. This has proven to be particularly preferred because pressure can be applied to the lid in a particularly simple manner when the container is placed on a stable surface, for example by an operator applying the load of his weight on the lid, or else by manual application of a force. The area onto which pressure is applied (pressure area) is preferably arranged above the connection portion in the vertical direction, so that the manual access to the lid extension for releasing it for disengaging the fastening means between the lid extension and the container will not or not significantly be hindered by the exerted pressure. Thus, when pressure is applied to the lid, the pressure force and hence also the deformation and/or displacement of the pressure-loaded lid area is transferred to the connection portion and hence to the lid extension itself. This provides for particularly simple handling of the package for opening the container. Optionally, however, the area of the lid and/or the container onto which pressure has to be applied may else be provided next to the lid extension with respect to the circumferential direction of the container; for example a pressure force has to be applied on a portion of the container skirt for this purpose, for displacing the connection portion and hence for example also the fastening means of the container relative to the lid extension to thereby allow the fastening means to be released more easily. However, particularly preferably the container with lid is designed such that a pressure force is exerted on an upper lid area, in particular the upper lid rim, in order to elastically deform and/or displace this lid area, and this deformation or displacement causes a deformation or displacement of the connection portion and hence a deformation and/or displacement of the lid extension relative to the fastening area of the container to thereby allow the fastening means to be released more easily.

Particularly preferably, the pressure can be exerted onto the upper lid region which defines a circumferential lid rim which is arranged radially outside of the inner lid surface that closes the container opening. This upper lid region onto which the pressure is applied is particularly preferably embodied as a lid portion that is arranged above the upper edge of the container in the vertical direction. This upper lid region as a pressure area may be arranged in alignment with the upper container edge in the radial direction of the container, but may also be radially spaced therefrom, for example radially outward therefrom, more preferably radially inward therefrom, whereby manual manipulation becomes particularly simple and the container can stand stable on the support surface. On the one hand, the respective region of the lid is particularly easy to access, on the other hand, when a pressure is applied in the vertical direction, this pressure is then transferred to the ground via the container lateral wall, in the vertical direction, so that the container is arranged particularly stable and furthermore the required pressure forces can be applied in a simple manner and/or to a high degree, for example by the operator supporting himself on the upper lid rim and loading the latter with its own personal weight. On the other hand, this allows to manually apply a high pressure force in a simple manner, and the fastening means between the lid extension and the container are particularly reliable therefore, since the fastening means between the lid extension and container can be made particularly tough so as to be released only by applying a relatively great force, or since the required relative displacement of the lid extension relative to the fastening means of the container requires a relatively large displacement in order to be able to release the fastening means. As a result, high container safety is provided against unintentional opening on the one hand, and on the other hand particularly simple manipulation of the package for opening it.

The pressure area of the lid rim may be provided adjacent to an at least substantially horizontal lid rim portion overlapping the upper container edge, preferably radially inward thereof. In this case, the pressure area may be a section of a downwardly open channel of the lid, preferably a U-shaped channel which may extend along a larger range of the container's circumference or completely around the lid. The pressure area may also be a projection of the lid or a portion thereof, wherein the projection is preferably open at the lower side thereof and may have a box-like shape, for example. As a result, the pressure area can be easily actuated manually and also with high pressure. The pressure area is preferably arranged axially or vertically above the lid rim portion overlapping the upper container edge and is therefore particularly easily accessible. The pressure area of the lid may be provided with stiffening elements such as stiffening webs for enhanced transfer of the pressure.

According to a particularly preferred embodiment, the lid and the container are spaced apart by a spacing in the vicinity of the fastening means of the lid extension and the container, which spacing can be reduced by exerting a pressure on the lid and/or on the container, thereby causing displacement of the fastening means of the lid extension and the container relative to each other while reducing said spacing, thus allowing said fastening means to be disengaged from each other more easily or at all. The pressure is preferably applied with a directional component or at least substantially in the vertical direction, particularly preferably towards the container bottom. Due to this spacing, a deformation and/or displacement will, for example, only be required in a lid area or in a container area located in the vicinity of said spacing and will at least substantially be limited thereto. The deformed and/or displaced area can or will so be introduced into the provided space given by said spacing, so that less defined deformations and/or displacements in other areas of the lid and/or of the container are avoided, which could for example lead to a weakening of the latching connection between the lid and the container by the first latching rims thereof and/or to leakage of the package. Said spacing between the areas of the lid and the container may in particular be a spacing in the vertical direction. Preferably, said spacing extends completely over the circumferential extent of the fastening means on the container and/or over the entire circumferential extent of the lid extension circumferentially of the container, particularly preferably even laterally beyond, whereby the fastening means can be reliably disengaged from each other by the application of pressure. However, the extent of this spacing in the circumferential direction of the container is preferably not greater than 4 times or 3 times or 2 times, in particular not greater than 1.5 times the extent of the fastening means or of the lid extension. Furthermore, this spacing allows to achieve a comparatively large displacement of the lid extension relative to the fastening means of the container in the direction that allows to open the fastening means more easily without deforming or displacing other areas of the container and/or lid, at least not substantially, that is to say, for example, without partly disconnecting the latching means of the lid and the container or affecting the tightness of the package. So, in this way, enhanced container safety and/or transport safety of the package are provided at the same time. Said spacing between the lid area and the container area in the vicinity of the fastening means of the lid extension and of the container, in particular between the at least substantially horizontal lid portion and the upper container edge, preferably amounts to at least approximately the amount of an overlap of the interengaging fastening means of the lid and the container that prevents the fastening means from disengaging. By reducing the spacing, the overlap is reduced, thereby allowing the fastening means to be released more easily.

Generally, the lid extension is preferably arranged centrally within the circumferential extent of the range of said spacing. Preferably, the lid extension is generally arranged in the region of the greatest vertical extent of the range of this spacing.

Preferably, the upper container edge engages on the underside of a section of the lid rim, preferably a section of the lid rim extending transversely, more preferably at least substantially horizontally, or perpendicular to the main axis of the container, at least substantially over the circumferential extent of the latching means of the container and the lid which are provided in the region of the upper container edge. With the latching means between the lid and the container, the lid is fixed to the container without clearance. In the vicinity of the fastening means between the lid extension and the container, the lid portion which otherwise engages on the upper edge of the container is raised so as to be spaced apart vertically from the upper container edge to provide a spacing which can be reduced by applying a pressure to the lid and/or to the container in order to cause a displacement of the fastening means and thus allow them to be released more easily. In order to ensure tightness of the package, fully circumferential sealing means are provided on the container and on the lid preferably radially inward and/or radially outward of the upper container edge, particularly preferably on the inner surface of the container lateral wall.

Preferably, the first latching rim of the lid and/or the first latching rim of the container, in particular the first latching rim of the container, is formed as a fully circumferential latching rim around the lid or the container.

In said region of the circumferential extent of the vertical spacing between the lid and container, the latching rim of the lid is preferably interrupted or weakened with respect to a latching connection with the container latching rim in order to allow for a more easy initiation of the unlatching of the first latching rims of the lid and the container, but may else optionally be continuous. Such weakening may be provided, for example, by a plurality of interruptions of the latching rim, or by a latching rim of reduced radial extent.

The upper container edge may lie completely in one plane, so that, if needed, the container may as well be closed by a lid in which the portion of the upper lid rim directly arranged above the upper container edge can engage on the container edge along the entire circumference thereof, as is the case with conventional containers. On the other hand, the container will have the same container height along its entire circumference in this way, so that the filling level of the container with a filling material is not reduced by any lowered section of the upper container edge. Furthermore, this allows the first latching rim of the container to be molded directly to the upper edge of the container or at a small vertical spacing thereto on the container lateral wall, and the first latching rim of the container may extend completely circumferentially around the container, whereby the region of the upper container edge is additionally stabilized, which is also advantageous with respect to the application of a pressure to the lid for releasing the fastening means. Alternatively or additionally, however, the latching means of the container may optionally also be molded integrally with a skirt that is integrally molded with the container's outer surface and protrudes radially outward from the container wall, which skirt has an at least substantially horizontal portion and a portion depending towards the bottom of the container, i.e. a preferably at least substantially vertical portion. Optionally, the first container latching rim may also be provided below the upper container edge, in which case the region in which a lid section is vertically spaced from the upper container edge and which is provided in the vicinity of the fastening means of the lid extension and the container, may be provided between the container latching rim and the upper container edge. In the vicinity of those fastening means, the upper edge of the container may therefore have a vertical recess. Optionally, it is also possible to implement both variants for providing a spacing between the upper container edge and the lid portion arranged immediately thereabove and preferably extending transversely or perpendicular to the main axis of the container.

Preferably, the lid has a fully circumferential rim on its upper side, also referred to as "upper lid rim" herein, which has an upward extending (raised) circumferential section in the vicinity of the lid extension and/or the fastening means, which therefore has a greater distance to the container bottom and preferably also to the upper container edge compared to the circumferentially adjacent non-raised section of this rim. The non-raised lid rim section may in particular be provided within the range of the (first) latching connection between the lid and the container, in particular within the range of the latching rim of the lid, and/or in a lid rim region without lid extension. Thus, the raised lid rim section may form a protrusion or protuberance of the lid rim extending away from the container bottom compared to the adjacent lid section circumferentially of the container.

The raised lid rim section may extend over the entire extent of the lid extension circumferentially of the container, or over a portion thereof, preferably not over more than 90% or more than 45% or more than 30% of the lid circumference. The "non-raised lid rim section" taken as a reference point may be spaced apart from the lid extension in the circumferential direction by ≥90% or ≥120% of the extension of the projection in the circumferential direction of the container. Thus, due to the raised lid section, a flat plane placed loosely on the top of the lid would be oblique, i.e. at an angle unequal to 90° relative to the main axis of the container, while the plane extends over the entire lid surface and the entire lid circumference, if considering a package that has only one extension and associated fastening means. This applies to a respective originally sealed package consisting of container and lid. Apart from the raised lid rim section, the lid rim is preferably flat, or any protrusions terminate in a plane with respect to their height, and this plane preferably lies perpendicular to the main axis of the container, and the raised lid rim section extends above this plane. The raised section and the non-raised section of the lid rim are arranged in extension to each other circumferentially of the container. Preferably, the raised section and the non-raised section of the lid rim continuously merge into one another in their height. The two sections mentioned may as well be structured vertically, for example formed with preferably box-shaped projections, wherein the top of the raised projection may exceed in height, i.e. in the direction of the container height, the projection of the non-raised region.

The upper rim of the lid with the raised lid rim section may overlap the upper edge of the container, i.e. may be arranged at the same radial spacing from the main axis of the container as the latter or directly thereabove, while the non-raised section of this lid rim portion may engage on the upper edge of the container whereby the lid is supported on the container (variant 1). With the raised lid rim section, a vertical spacing can be provided to the upper edge of the container, which spacing is reduced upon actuation of the actuator area or of the deformable and/or displaceable lid area thereby allowing the fastening means to be released more easily.

Particularly preferably, said upper lid rim with the raised section represents the uppermost portion of the lid, that is to say the lid region with the greatest distance to the container bottom in the case of the originally sealed container. This may be implemented in combination with the aforementioned variant 1. The uppermost lid rim may be formed, for example, as a type of bulge, such as a channel opening towards the container bottom, preferably a U-shaped channel which radially inwards merges into the lid's inner surface sealing the container opening, optionally via further cross-sectional profiles. The uppermost lid rim is preferably spaced apart radially from the aforementioned lid rim that overlaps the upper edge of the container, preferably it is arranged radially inwards thereof. As a result, high stability of the lid is provided, in particular also upon actuation of the actuator area, as well as a favorable force transfer from the actuator area to the fastening means in order to allow them to be released more easily.

The raised lid rim section on the upper rim of the lid, in particular on the uppermost lid rim preferably defines the actuator portion or deformable and/or displaceable area of the lid.

Said upper or uppermost portion of the lid preferably extends at least substantially horizontally, that is to say at an angle of <+/−45° or <+/−25°, particularly preferably of <+/−15° or further preferably of about 0° relative to a perpendicular to the main axis of the container, that means approximately perpendicular to the main axis of the container. The upper or uppermost portion of the lid is preferably formed in two dimensions, with an extent in the radial direction and in the circumferential direction of the container.

The upper and/or uppermost lid rim is preferably flat, except for said raised portion, optionally also in the form of a plurality of spaced apart elevations in the circumferential direction of the container. The raised lid rim section in the vicinity of the lid extension preferably merges continuously in its height into the non-raised lid rim section.

With said raised lid rim section, the lid can be attached to the container particularly easily by a machine, and not only is the lid fixed on the container in the fastening process of the lid, but moreover the lid extension is preferably brought into engagement with the fastening means of the container, optionally in two steps, preferably in one step. This can be done in an automatic filling facility, for example. For example, a machine-operated tool such as a pressure plate may be pressed against the lid in the vertical direction in order to interengage the latching means but also the further fastening means in the vicinity of the lid extension between the lid and the container. When pressed down by a flat pressure plate, the lid, due to the aforementioned elevation of the lid rim, will be depressed to a greater extent towards the container bottom in the vicinity of the lid extension than lid rim sections which are spaced apart from the lid rim elevation in the circumferential direction of the container. A pressure roller may be used as a tool as well, for example, which roller preferably extends over the entire width of the container and presses the lid against the container to interengage the latching means and the fastening means between the lid and the container, while the pressure roller is moved across the lid. Once the roller engages on the aforementioned lid elevation, this lid rim section will be lowered to a greater extent than the lid rim sections spaced apart from the elevation and in this way the fastening means between lid extension and the container will also be brought into engagement with one another. In this way, the container can be easily closed with the lid in automated manner. Other suitable tools can accordingly be used as well.

Preferably, the container has a skirt that extends at least substantially around the circumference of the container, is integrally molded with the outer surface of the container's lateral wall and extends radially outward. Preferably, the skirt has an at least substantially horizontally extending portion which engages below the lower edge of the lid thereby protecting it against manual engagement. At the same time, the upper region of the container is stabilized by the skirt in this way. Preferably, the skirt has a portion extending towards the container bottom, which is integrally molded with the radially outward edge of the at least substantially horizontally extending skirt portion.

The container skirt preferably extends at least substantially around the entire circumference of the container. Preferably, the container skirt has an interruption in the vicinity of the lid extension or a portion with a smaller radial extent starting from the lateral wall of the container. Preferably, the lid extension is arranged within the region of interruption of the skirt or the region of smaller radial extent of the skirt, so that the skirt is located on either side of the extension over its cross-sectional range and thereby protects the lid extension, in particular against an application of force from a lateral direction with respect to the extent of the extension. Preferably, the fastening means of the container cooperating with the lid extension are likewise arranged within said range of the interruption of the circumferential extension of the skirt or skirt portion of smaller radial extent, so that the fastening means of the container are also protected laterally by the skirt. In addition, the tamper-evident closure of the container may be integrally formed with the container skirt so as to overlap the lid extension and without protruding quite far in the radial direction from the skirt, while the tamper-evident closure, in particular in the form of a tamper-evident tab, may radially protrude beyond the skirt, so that it is easier to grasp.

Particularly preferably, the fastening means of the container are molded integrally with a container portion radially projecting outward from the container lateral wall which is laterally spaced apart from the container skirt or separated therefrom by a recess that extends in the vertical direction of the container. As a result, the supporting portion of the fastening means on the container is elastically deformable, in particular elastically deformable to a greater degree than the container skirt, whereby the engaging of the fastening means of the lid extension with those of the container becomes more easy.

Particularly preferably, the fastening means between the lid extension and the container are provided in the form of latching means which hence constitute second latching means, in addition to the first latching means of the container and the lid, which extend at least substantially completely around the circumference of the container.

Particularly preferably, the (first) latching means between the container and the lid are provided at a different level with respect to the height of the container, that is at a different vertical distance from the container bottom than the fastening means between the lid extension and the container. This makes it easier to actuate or release the fastening means between the extension and the container independently of the first latching means, that is to say to disengage said fastening means from each other without even partially actuate or release the first latching means.

Preferably, the fastening means of the extension or the corresponding fastening means of the container are hook-shaped, preferably with an extension of the hook in the direction of the pressure direction for the elastic deformation and/or reversible displacement of the lid or container area for disengaging the fastening means from one another. In this case, the one or more hooks of the fastening means may engage behind a portion of the other component of the lid and container, for example by passing through an opening of the respective component such as the extension. So, when the pressure is exerted and the extension is displaced relative to the fastening means of the container, the extent of engagement of the hook therebehind will be reduced or possibly even completely eliminated, due to the given extension of the hook in the direction of the pressure, so that the fastening means of the lid and the container can then be easily released manually, for example by displacing or pivoting the lid extension relative to the container.

Preferably, the fastening means of the extension or the corresponding fastening means of the container are hook-shaped, with a chamfer in the region of the undercut of the hook, in particular at the free end portion of the hook, which is preferably provided on the front side of the hook facing away from the container lateral wall. Thus, the hook tapers towards its free end. As a result, the fastening means can be brought back into engagement with each other more easily after having been released for a first time, even if the hook is not completely disposed at the level of the corresponding opening upon maximum intended deformation or displacement of the lid area, for example when the lid is pressed down. On the other hand, loosening of the fastening means without prior deformation or displacement of said lid or container area is further hampered in this way, thereby providing high container safety.

Preferably, the lid extension is at least partially covered by a tamper-evident closure, in particular in the form of a tamper-evident tab which is integrally molded with the container, preferably with the container skirt, so as to be detachable or displaceable. The tamper-evident closure may extend across the entire width of the lid extension. The fastening means between the extension and the container can therefore only be disengaged from one another when the tamper-evident closure has been displaced or removed from the container, in particular manually, by destroying at least one linkage between the tamper-evident closure and the container. Thus, an indication is provided when the lid extension for releasing the lid has been actuated for the first time. Here, the tamper-evident closure or tamper-evident tab may overlap the lid extension over the entire extent thereof circumferentially of the container.

The lid extension preferably protrudes downwards beyond the tamper-evident closure, towards the container bottom. So, optionally, the tamper evident closure can be removed by pivoting or displacing the lid extension, thereby allowing the container to be opened more easily. Thus, the lower portion of the lid extension can be grasped manually, even in the case of an originally sealed container. Furthermore, based on the protruding of the lid extension beyond the tamper-evident closure it is easier for the user to realize at which point of the container the latter has to be manipulated in order to open the container.

Preferably, the lid has a circumferential flange which preferably extends around the entire circumference of the container and which engages on the inner surface of the container lateral wall when the lid is attached. On the one hand, this allows to provide a sealing region or a further sealing region between the lid and the container. Furthermore, this stabilizes the position of the lid relative to the container when the lid is subjected to a pressure to deform or displace a lid portion and thus also displace the lid extension relative to the fastening means of the container in order to release the fastening means.

Preferably, the tamper-evident closure is arranged on the container at a radial spacing from the outer surface of the lid extension, and with the tamper-evident closure integrally molded with the container, the extension can engage behind the tamper-evident closure when the lid is being attached to the container. This allows the lid to be fixed on the container in a simple manner by a machine in order to close the container with the lid for the first time, for example after the container has been filled.

Preferably, the lid extension and the corresponding fastening area of the container comprise a plurality of fastening means preferably spaced apart in the circumferential direction of the container. In this way, a particularly reliable fixing of the lid extension to the fastening means of the container is provided.

The lid may be embodied as a hinged lid comprising two lid parts each of which partially closes the container opening and which may be integrally molded to one another such that they can be displaced, in particular pivoted. When a first one of the lid parts is fixed on the container by the first latching means, the second lid part can be displaced in order to (partially) open the container. The first lid part can remain firmly latched on the container in this case, optionally in the manner as is the case with the original sealed container. The lid extension may be provided on the second lid part is this case. The two lid parts may be linked to each other by a joint such as a hinge, preferably integrally. However, it is likewise possible for the lid to be not in the form of a hinged lid, but a common lid which (except for the lid extension) is manipulated in the manner of a substantially planar component.

The container of the invention is preferably a plastic container, in particular an injection-molded plastic container. The lid is preferably a plastic lid, in particular an injection-molded plastic lid. In this way, the container and/or the lid are particularly well adapted for their function. Preferably, the lid is formed in one piece.

Generally, the package according to the invention may comprise a plurality of lid extensions that are arranged around the container as well as fastening means associated therewith, but may else in particular only have just one.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
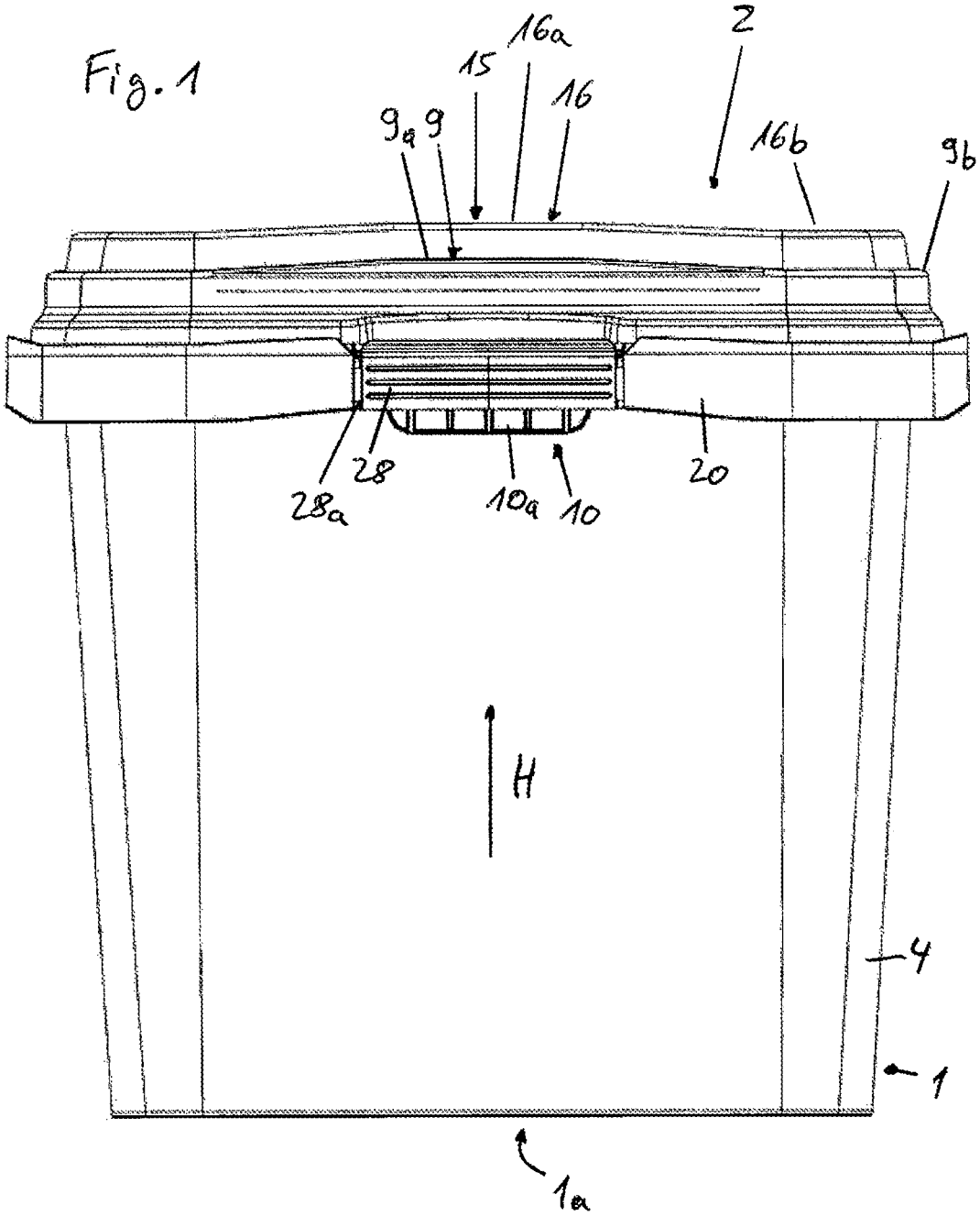
FIG. 1 is a side elevational view of a container according to the invention.
Figure 2:
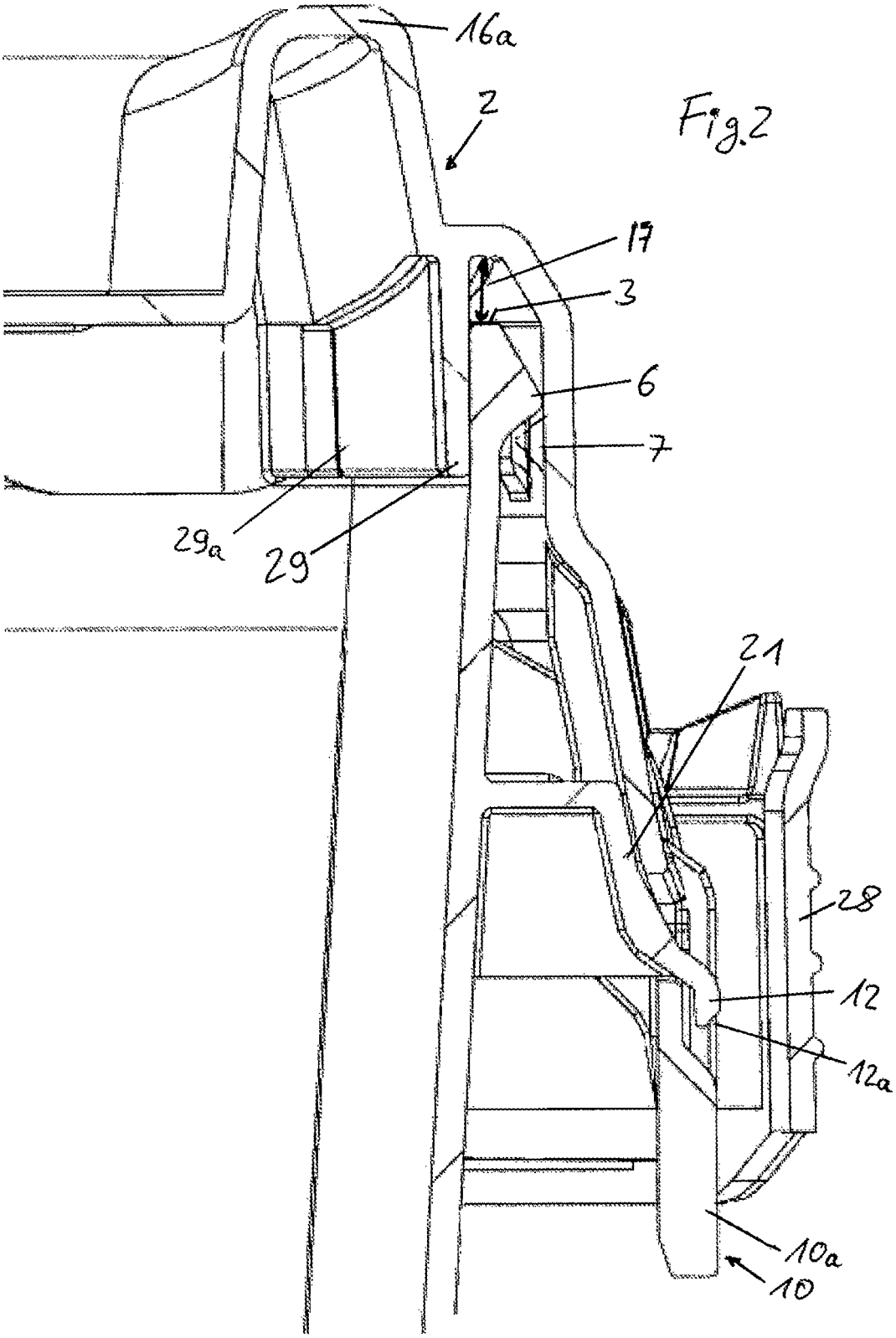
FIG. 2 is cross-sectional view of the container of FIG. 1 in the region of the lid extension.
Figure 3:
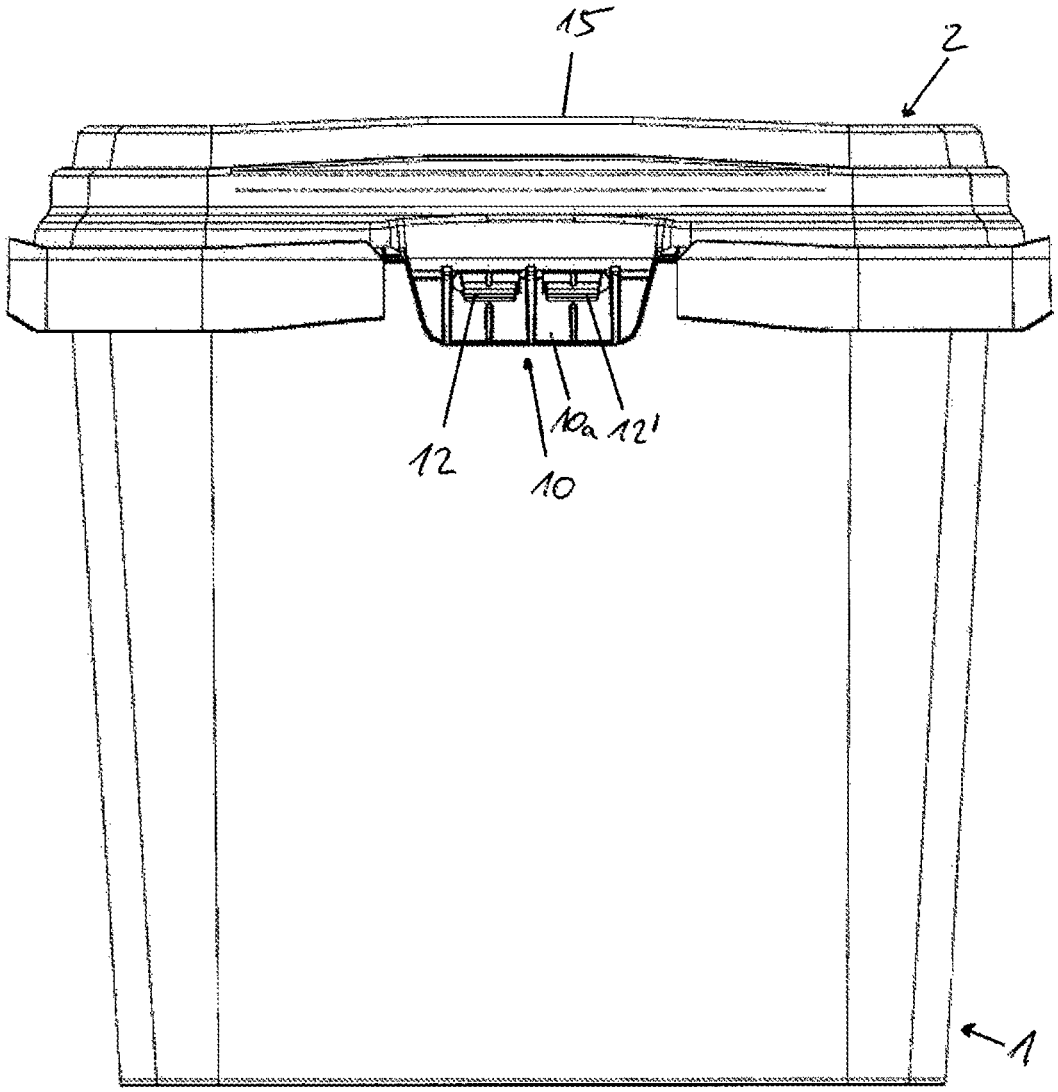
FIG. 3 is a view of the container of FIG. 1 with the tamper-evident closure removed.
Figure 4:
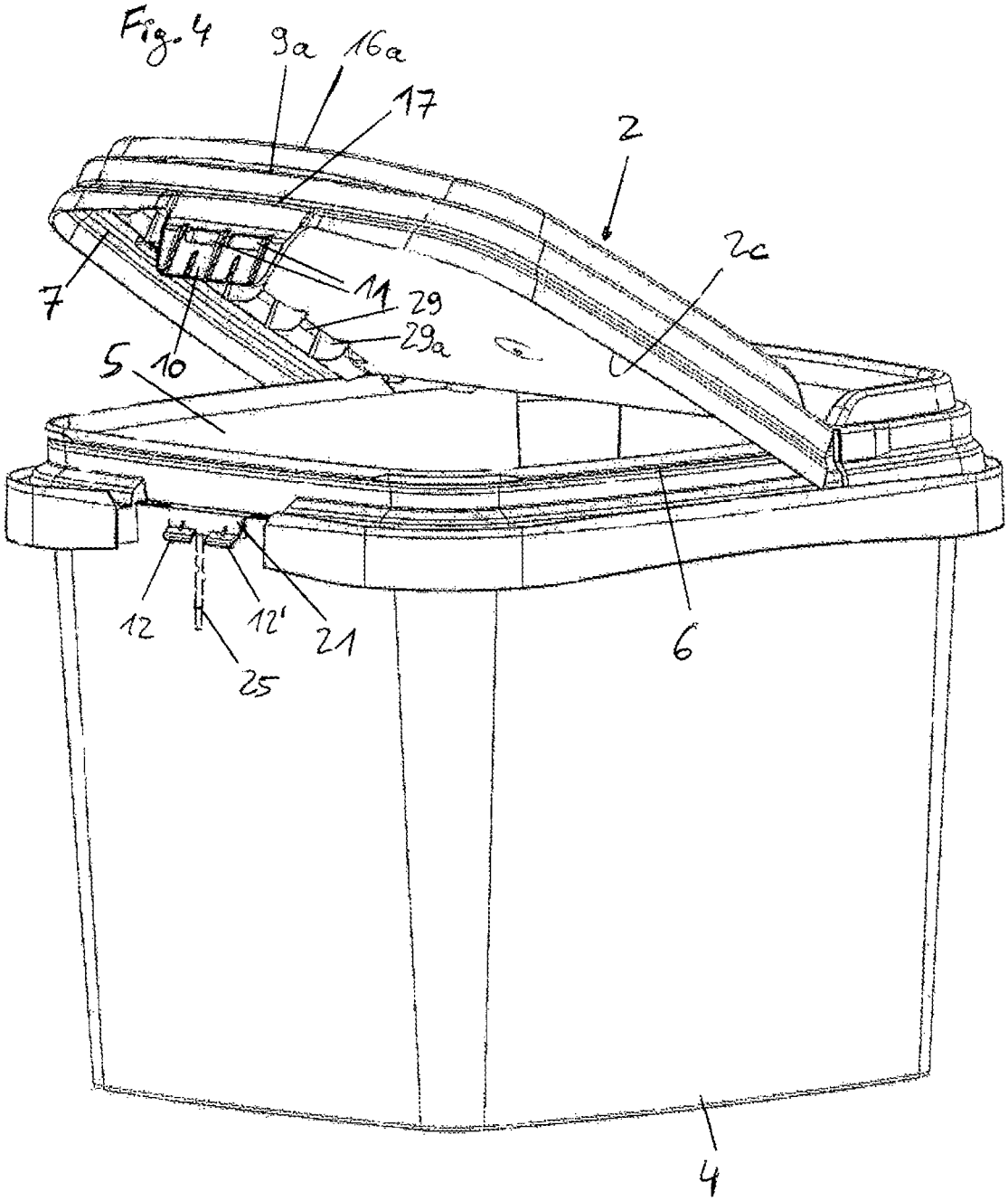
FIG. 4 is a view of the container of FIG. 3 with the lid open.

FIGS. 1 to 4 show a container 1 with a lid 2, the container 1 having an upper container edge 3 and a fully circumferential lateral wall 4 extending around the full circumference and an upper container opening 5 closed by said lid. In the region of the upper container edge 3, a container latching rim 6 is provided for a latching connection to a corresponding latching rim 7 provided on the lid 2, wherein the latching rims 6, 7 of the container and the lid each extend at least around part of the circumference thereof. In the present case, the container latching rim 6 is formed so as to extend around the entire circumference, the lid latching rim 7 is formed to extend around part of the circumference and has a circumferential interruption in the region of a lid extension 10. The latching rim 7 is therefore shown by a dashed line in FIG. 2.

The lid 2 has a lid rim portion 9 arranged above the upper container edge 3 and covering it. The lid rim portion 9 comprises a circumferential portion 9*b* that engages on the container edge 3 and bears thereon in the vertical direction (direction of the main axis H of the container). The lid 2 has at least one extension 10 extending outside of the lateral wall 4 of the container 1, and extending below the lower lid edge 2*c*, and the extension 10 and the container 1 have mutually corresponding fastening means 11, 12 which can be released independently from the latching means defined by the latching rims 6, 7 of the container and the lid. Here, the fastening means 11 of the lid extension are in the form of through-openings, the fastening means 12 of the container in the form of hooks, which optionally could be implemented vice versa as well. The fastening means 11, 12 are each provided in the form of a pair here, spaced apart in the circumferential direction of the container.

In the region of the fastening means 11, 12 between the lid extension 10 and the container, the lid and/or the container has an actuator area 15 to be actuated by application of a force, which is provided on the lid in the present case, and which is different from the fastening means 11, 12 on the lid extension 10 and the container 1 and/or from the lid extension itself. After the actuator area 15 of the lid and/or the container have been actuated by application of a force, the fastening means 11, 12 between lid extension 10 and container 1 are more easily releasable and also easier to close than without actuation of the actuator area 15 by application of a force. Here, the actuator area 15 is provided by a section 16*a* of the uppermost lid rim 16 which therefore includes the lid area with the greatest distance from the container bottom 1*a*. The lid rim 16 extends horizontally, at least substantially. Lid rims 9 and 16 are formed so as to extend fully circumferentially of the lid and container. Section 16*a* of lid rim 16 defining the actuator area 15 is raised here as compared to the section 16*b* of lid rim 16, which is not raised and extends in a plane. Sections 16*a* and 16*b* continuously merge into one another in their height. The actuator area 15 is arranged above the lid extension 10 and the fastening means 11, 12. Lid rim 16 is offset from lid rim 9 radially inwards. Lid rim 9 also has a raised section 9*a* and a non-raised section 9*b*. In the region of raised rim section 9*a*, the lid rim which otherwise bears on the container edge within the range of section 9*b*, is spaced apart vertically from the container edge 3 thereby defining the free space or spacing A. Lid rim 9 may as well be considered as an actuator area. The raised rim section 9*a* is spaced apart from the level of the upper container edge 3. By actuating an actuator area, in particular the actuator area 15, in particular by pressing or pressing it down towards the container bottom, the lid is deformed in the region of sections 9*a*, 16*a* and the spacing A is reduced, and thereby the lid extension 10 is displaced towards the container bottom. As a result, the fastening means 11, 12 are displaced relative to one another, and the locking between them is at least partially, largely or at least substantially completely released or disengaged from one another. The complete disengagement of the fastening means 11, 12, in particular by grasping the lid extension, is thereby made substantially easier, for which purpose the lid extension has to be transferred from its closed position with the originally sealed container into its open position. Here, the transferring is achieved by pivoting the lid extension. Thus, the movement of the fastening means 11, 12 by actuating the actuator area 15, namely a translational movement, is different from the movement of the extension 10 for transferring it into its open position, namely in a pivotal movement. In order to be able to disengage the fastening means 11, 12 from one another more easily or at all, or to be able to transfer the extension 10 into its open position, the actuator area has to be actuated under permanent application of a force, i.e. it has to be pressed down here.

The actuator area to be actuated by application of a force is designed as an elastically deformable and/or reversibly displaceable area of the lid, here, namely in the form of lid rim sections 16*a* and 9*a*, respectively, which are elastically deformed and/or reversibly displaced under application of a force. Optionally, an actuator area for displacing the lid extension may as well be provided on the container lateral wall, for example, such as e.g. on the container skirt 20. However, the arrangement in an upper or the uppermost region of the lid is particularly preferred because it is easily accessible with high force and can be actuated without displacement of the container.

The lid extension 10 is integrally molded with an elastically deformable and/or reversibly displaceable area of the lid in this case, namely to the lower lid edge portion 17 which is likewise deformed when section 16*a* or 9*a* is deformed. Optionally, an actuator element 25 could likewise be integrally molded with the supporting web 21 of the container 1, which carries the fastening means 12, which actuator element, when actuated, could cause the supporting web 21 to be elastically deformed and/or displaced in order to change the position of the fastening means 11, 12 relative to one another so that they can be disengaged more easily by continuous application of a force on the actuator area 25.

The container 1 with lid 2 is designed such that the fastening means 11, 12 of the lid extension 10 and of the container 1 are not disengageable from each other in a non-destructive manner without previous actuation of the actuator area 15 by application of a force and elastic deformation and/or reversible displacement of sections 9*a* and 16*a*, respectively, of the lid or of the portion 25 of the container, since the hook-shaped fastening means 12 of the container engage behind the lid extension 10 with an excessively large overlap. Once a force is applied on the actuator area 15 and this force is maintained or the elastic deformation of the regions 9*a*, 16*a* or 25 is maintained so that the fastening means 11, 12 are displaced relative to one another, the fastening means 11, 12 can be reversibly disengaged from each other non-destructively. By actuation of the actuator area it is possible to completely or largely eliminate the engagement of the fastening means 12 behind the lid extension, so that a slight engagement of the hook-shaped fastening means therebehind can be overcome by changing the position of the extension 10, such as by pivoting, towards the open position thereof.

The package must be manipulated with both hands to open it, namely by actuating the actuator area 15 and simultaneously displacing the lid extension 10, but can be closed with one hand, namely by pressing the lid onto the container.

The lid extension 10 or alternatively the fastening area of the container around the fastening means 12 is integrally molded with one of a portion of the lid, here the lid edge 17, or of the container, here the supporting web 21, and when pressure is applied to the lid and/or to the container thereby pressing said connection portion 17, 21 against the other one of the lid or the container, said connection portion 17, 21 is displaceable while causing a displacement of the lid extension 10 relative to the fixing area of the container.

In the vicinity of the fastening means 11, 12 of the lid extension and of the container, the lid and the container are spaced apart by a spacing A from one another, which spacing can be reduced by a force-exerting actuation of the actuator area 15 thereby causing a displacement of the fastening means of the lid extension and of the container relative to one another.

Within the circumferential range of the latching means 6, 7 of the lid 2 and of the container 1, the upper container edge 3 engages on the underside of a section 9*b* of the lid rim 9, and in the vicinity of said fastening means 11, 12, namely within the range of section 9*a*, the lid rim 9 is spaced apart vertically from the upper container edge 3. As a result, the spacing A is defined.

Figure 5A:
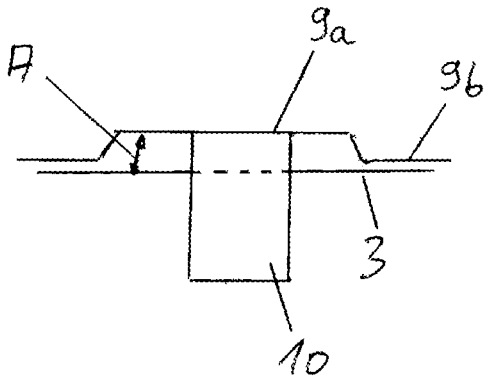
FIG. 5*a* is a schematic view of a portion of the container of FIG. 1
Figure 5B:
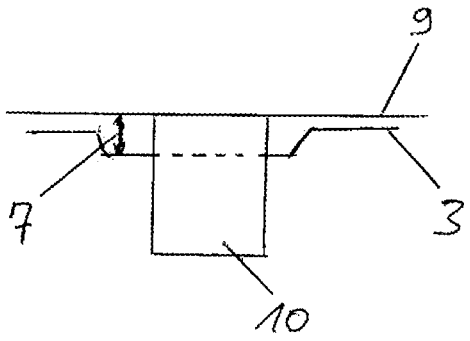
FIG. 5*b* is a modification thereof.

FIG. 5*a* schematically shows the fastening area of the lid extension 10 and the spacing A due to the raised lid rim section 9*a*. FIG. 5*b* shows a modification. The at least substantially circumferential container latching edge 6 is arranged below the upper container edge 3, here. The region of the spacing A between the lid portion and the upper container edge within the vicinity of the fastening means 11, 12 of the lid extension 10 and of the container 1 is defined here by the fact that the container latching edge 6 has a different spacing to the upper container edge 3, that is the upper container edge is lowered within the vicinity of the lid extension.

The fastening means 12 of the container are integrally molded with a container portion radially projecting outwards from the container lateral wall 4, here the supporting web 21. Alternatively, the circumferential container skirt 20 may have a small radial extent in the vicinity of the lid extension, and the fastening means 12 may be integrally molded with this skirt section (not shown) which is recessed towards the lateral wall 4.

The fastening means 11, 12 between lid extension and container are designed as positively locking means here, more precisely as (second) latching means.

The fastening means 12 of the container are hook-shaped, wherein towards its free end the hook extends in the direction of the pressure direction upon actuation of the actuator area or the elastic deformation and/or reversible displacement of the lid section for disengaging the fastening means from each other. The corresponding fastening means of the lid extension 10 are in the form of an aperture or through-opening into which the hook can engage and the extension can engage behind. Vice versa, it is also possible that hook-shaped fastening means are provided on the lid extension, while the corresponding fastening means of the container may be formed as a recess, for example as a through-opening in the skirt. However, more generally within the scope of the invention, the fastening means of the extension and the container may also be designed as hooks engaging behind one another or in another appropriate manner.

The hook-shaped fastening means, here those of the container (reference numeral 12) have a chamfer 12*a* in the region of the undercut of the hook, here on the outer side of the hook. As a result, the fastening means 11, 12 are easier to return into engagement when closing the fastening means, especially when the extension is transferred into its closed position and the hook end comes into contact with the extension and is not completely disposed at the level of the through-opening 11 of the extension. In this way, a particularly high opening resistance is produced in the closed position of the extension when the actuator area 15 is not actuated.

For closing the container, the lid can be applied thereon and the at least substantially completely circumferential first latching means on the container and on the lid rim can be brought into engagement with one another. Then, pressure can be exerted on the actuator area, for example manually or by a machine. In this way, the fastening means of the lid extension and the container are positioned relative to each other such as to allow to effect the fastening engagement. In this case, the supporting portions and/or the fastening means themselves are biased, for example by being urged onto one another, and at least one or both fastening means and/or one or both of the supporting portions thereof are elastically deflected. According to the exemplary embodiment, the lid extension 10, optionally alternatively or additionally also the supporting portion 21 of the container fastening means, can be elastically deformed and biased in this case. Upon sufficient further movement of the actuator area, here depression thereof, the fastening means of the lid extension and of the container will preferably interengage automatically, whereby the bias is reduced or eliminated, and the container will be properly closed again. In this way, the container can be repeatedly opened and closed, preferably any number of times.

The lid extension 10 is covered by a tamper-evident closure 28, which is integrally molded with the container in a detachable or displaceable manner, in the present case to the skirt of the container, through linkages 28*a*. The lid extension 10 projects downwards towards the container bottom, beyond the tamper-evident closure 28*a*, by a portion 10*a* of the extension.

The lid 2 has a circumferential flange 29, which preferably sealingly engages on the inner surface 4*a* of the container lateral wall 4 when the lid is attached. The sealing flange 29 is stabilized by radial webs 29*a*. As a result thereof, high tightness of the package is provided upon actuation of the actuator area 15, even when a region of the lid is deformed.

The tamper-evident closure 28 is provided at the container with a radial spacing to the outer surface of the lid extension 10, such that with the tamper-evident closure 28 integrally molded with the container, the extension 10 can engage behind the tamper-evident closure 28 when the lid is being placed on the container for the first time, for example after the container has been filled. In this case, the front side of the extension will directly face the rear side of the tamper-evident closure 28.

To increase the safety of the container, the lid extension 10 and the corresponding fastening area of the container may have a plurality of fastening means 12, 12', preferably spaced apart in the circumferential direction of the container.

Each of the container and the lid may in particular be provided as one-piece plastic parts, in particular injection molded plastic parts.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A container with lid, the container having an upper container edge and a fully circumferential lateral wall and an upper container opening closed by said lid, wherein a latching rim is provided in a region of the upper container edge for a latching connection with a corresponding latching rim provided on the lid, wherein each of said latching rims of the container and the lid extends around at least part of the circumference thereof, wherein the lid has a lid rim portion arranged above the upper container edge, wherein the lid has at least one extension extending outside the lateral wall of the container and extending below a lower edge of the lid, and wherein the extension and the container have mutually corresponding fastening means which are releasable independently of the latching means defined by the latching rims of the container and the lid, wherein the lid extension is designed to be pivoted in order to disengage the fastening means of the extension and the container;

wherein in the vicinity of the fastening means between the lid extension and the container, the lid and/or the container has an actuator area to be actuated by application of a force, which actuator area is different from the fastening means on the lid extension and the container and is different from the lid extension itself; and wherein, when the actuator area of the lid and/or container has been actuated by application of a force, the fastening means between the lid extension and the container are releasable with a lesser releasing force than when the actuator area has not been actuated by application of a force, wherein the actuator area to be actuated by application of a force is designed as an elastically deformable and/or reversibly displaceable area of the lid and/or the container, which is elastically deformed and/or reversibly displaced under application of a force in a translational movement in a direction to a bottom of the container, and wherein the actuation of the actuator area by application of the force in the direction to the bottom of the container causes a displacement of the fastening means of the container and the lid relative to each other, to release the fastening means between the lid extension and the container with less force.

2. The container of claim 1, wherein the actuation of the actuator area by application of a force causes a displacement of the fastening means of the container and the lid relative to each other in a direction which is different from the movement of the lid extension during the opening movement thereof.

3. The container as claimed in claim 1, wherein (i) the lid extension is integrally molded with an elastically deformable and/or reversibly displaceable area of the lid; and/or wherein (ii) the fastening means of the container are integrally molded with an elastically deformable and/or displaceable area of the container.

4. The container as claimed in claim 1, wherein the fastening means of the lid extension and the container are not disengageable from each other in a non-destructive way without previous elastic deformation and/or reversible displacement of said area of the lid or container, and are disengageable from each other in a non-destructive way once said elastic deformation and/or reversible displacement of said area of the lid or container has occurred.

5. The container as claimed in claim 1, wherein the lid extension and/or the fastening area of the container are integrally molded with a portion of one of the lid and container, and wherein, when pressure is applied to the lid and/or to the container thereby pressing the connection portion against the other one of the lid and the container, said connection portion is displaceable thereby causing displacement of the lid extension relative to the fastening area of the container.

6. The container as claimed in claim 1, wherein in the vicinity of the fastening means of the lid extension and the container, the lid and the container are spaced apart by a spacing, which spacing can be reduced by a force-exerting actuation of the actuator area, in particular by exerting a pressure on the lid and/or the container, in particular on the lid, thereby causing displacement of the fastening means of the lid extension and the container relative to each other.

7. The container as claimed in claim 1, wherein within the circumferential range of the latching means of the lid and the container, the upper container edge engages on the underside of a section of the lid rim, and wherein in the vicinity of said fastening means, the lid is spaced apart vertically from the upper container edge.

8. The container as claimed in claim 6, wherein the latching rim of the container is arranged below the upper container edge, and wherein the range of the spacing between the lid portion and the upper container edge in the vicinity of the fastening means of the lid extension and the container is arranged between the latching rim of the container and the upper container edge with regard to the height of the container.

9. The container as claimed in claim 1, wherein in the vicinity of the lid extension, an upper rim portion or an uppermost rim of the lid is raised compared to an upper rim of the lid within the range of the at least substantially circumferential latching connection between the lid and the latching rim of the container or compared to a lid rim region without lid extension.

10. The container as claimed in claim 1, wherein the fastening means of the container are integrally molded with a circumferential skirt of the container and/or to a container portion radially protruding outwards from the container lateral wall.

11. The container as claimed in claim 1, wherein the fastening means between the lid extension and the container are formed as a second latching means.

12. The container as claimed in claim 1, wherein the fastening means of the lid extension or the corresponding fastening means of the container are hook-shaped, wherein the hook extends in the direction of the pressure direction for the elastic deformation and/or reversible displacement of the lid area or container area for releasing the fastening means from one another.

13. The container as claimed in claim 1, wherein the fastening means of the lid extension or the corresponding fastening means of the container are hook-shaped, with a chamfer in a region of an undercut of the hook for enabling said fastening means to be easier locked to one another.

14. The container as claimed in claim 1, wherein the lid extension is integrally molded with the lid so as to be pivotable radially inward or radially outward with respect to the container.

15. The container as claimed in claim 1, wherein the lid extension is covered by a tamper-evident closure which is integrally molded with the container or with the container skirt so as to be detachable or displaceable.

16. The container of claim 15, wherein the lid extension projects downwards beyond the tamper-evident closure, towards a bottom of the container.

17. The container as claimed in claim 1, wherein the lid has a circumferential flange which engages on the inner surface of the container lateral wall when the lid is attached.

18. The container as claimed in claim 15, wherein the tamper-evident closure is arranged on the container with a radial spacing from an outer surface of the lid extension, and wherein, with the tamper-evident closure integrally molded on the container, the extension can engage behind the tamper-evident closure when the lid is being attached to the container.

19. The container as claimed in claim 1, wherein the lid extension and the corresponding fastening area of the container comprise a plurality of fastening means spaced apart in the circumferential direction of the container.

20. The container as claimed in claim 1, wherein the bottom of the container is arranged parallel to the container opening, and the container has a main axis arranged perpendicularly to the bottom and perpendicularly to the container opening, and wherein the upper container edge engages on an underside of a section of the lid rim, wherein in the vicinity of the fastening means between the lid extension and the container, the section of the lid rim engaging the upper container edge has a vertically spaced portion spaced apart vertically in a direction of the main axis of the container from the upper container edge, the main axis extending vertically, perpendicular to the bottom of the container, to provide a clearance between the upper container edge and said vertically spaced portion which can be reduced by applying a pressure to the lid and/or to the container in order to cause the displacement of the fastening means and thus allow the fastening means them to be released more easily.

21. The container as claimed in claim 1, wherein the bottom of the container is arranged parallel to the container opening, and the container has a main axis arranged perpendicularly to the bottom and perpendicularly to the container opening, wherein the upper container edge engages on an underside of a section of the lid rim, wherein in the vicinity of the fastening means between the lid extension and the container, the section of the lid rim engaging the upper container edge has a vertically spaced portion spaced apart vertically in a direction of the main axis of the container from the upper container edge to provide a spacing which can be reduced by applying a pressure to the lid and/or to the container in order to cause the displacement of the fastening means and thus allow the fastening means to be released more easily, and wherein a pressure area of the lid rim is provided radially inward from the upper container edge, and wherein the pressure area is a section of a downwardly open U-shaped channel of the lid, wherein the downwardly open U-shaped channel of the lid comprises two essentially vertical legs and an essentially horizontal section between the two vertical legs, a first leg and a second leg, having different distances from the container main axis, and wherein the essentially vertical leg of the U-shaped channel having the greater distance from the container main axis is arranged radially inwardly to the upper container edge.

* * * * *